US011939543B2

(12) United States Patent
Xu et al.

(10) Patent No.: US 11,939,543 B2
(45) Date of Patent: Mar. 26, 2024

(54) STEAM CRACKING PROCESSES AND THE USE OF SOLVENTS STREAMS PRODUCED BY SOLVENT-ASSISTED TAR CONVERSION PROCESSES

(71) Applicant: ExxonMobil Chemical Patents Inc., Baytown, TX (US)

(72) Inventors: Teng Xu, Houston, TX (US); James R. Lattner, La Porte, TX (US); Frank Cheng-Yu Wang, Annandale, NJ (US); Bryan Tiedemann, Webster, TX (US); Renyuan Yu, Humble, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 17/264,951

(22) PCT Filed: Jul. 9, 2019

(86) PCT No.: PCT/US2019/041003
§ 371 (c)(1),
(2) Date: Feb. 1, 2021

(87) PCT Pub. No.: WO2020/033092
PCT Pub. Date: Feb. 13, 2020

(65) Prior Publication Data

US 2021/0324276 A1 Oct. 21, 2021

Related U.S. Application Data

(60) Provisional application No. 62/716,754, filed on Aug. 9, 2018.

(30) Foreign Application Priority Data

Oct. 15, 2018 (EP) ..... 18200309

(51) Int. Cl.
*C10G 9/16* (2006.01)
*C10G 9/36* (2006.01)
(Continued)

(52) U.S. Cl.
CPC ..... *C10G 9/16* (2013.01); *C10G 9/36* (2013.01); *C10G 45/28* (2013.01); *C10G 69/06* (2013.01);
(Continued)

(58) Field of Classification Search
CPC ... C10G 9/12; C10G 9/16; C10G 9/36; C10G 45/28; C10G 69/06; C10G 75/00;
(Continued)

(56) References Cited

U.S. PATENT DOCUMENTS 4,324,643 A * 4/1982 Durai-Swamy ..... C10K 1/02 208/414
5,215,649 A * 6/1993 Grenoble ..... C10G 47/34 208/48 R
(Continued)

FOREIGN PATENT DOCUMENTS

CA 818586 7/1969
CA 2093218 4/1992

OTHER PUBLICATIONS

Kinghorn, R. M.; Marriott, P. J.; Dawes, P. A. J. High Res. Chrom., 2000, 23, 245-252.
(Continued)

*Primary Examiner* — Michelle Stein

(57) ABSTRACT

In an embodiment, a method for decreasing reactor fouling in a steam cracking process is provided. The method includes steam cracking a hydrocarbon feed to obtain a quench oil composition comprising a concentration of donatable hydrogen of 0.5 wt. % or more based on a total weight percent of the quench oil composition; exposing a steam
(Continued)

cracker effluent flowing from a pyrolysis furnace to the quench oil composition to form a mixture; and fractionating the mixture in a separation apparatus to obtain a steam cracker tar. In another embodiment, a hydrocarbon mixture is provided. The hydrocarbon mixture includes a mid-cut composition.

15 Claims, 2 Drawing Sheets

(51) Int. Cl.
*C10G 45/28* (2006.01)
*C10G 69/06* (2006.01)
*C10G 75/04* (2006.01)

(52) U.S. Cl.
CPC ..... *C10G 75/04* (2013.01); *C10G 2300/202* (2013.01); *C10G 2300/301* (2013.01); *C10G 2300/4081* (2013.01); *C10G 2300/42* (2013.01); *C10G 2300/44* (2013.01); *C10G 2300/807* (2013.01); *C10G 2400/18* (2013.01); *C10G 2400/30* (2013.01)

(58) Field of Classification Search
CPC .. C10G 75/02; C10G 75/04; C10G 2300/202; C10G 2300/301; C10G 2300/4081; C10G 2300/42; C10G 2300/44; C10G 2300/807; C10G 2400/18; C10G 2400/30
See application file for complete search history.

(56) References Cited

U.S. PATENT DOCUMENTS 5,443,715 A 8/1995 Grenoble
10,894,924 B2 * 1/2021 Coleman ..... C10G 65/10
11,286,435 B2 * 3/2022 DeLaney ..... B01D 3/143
11,352,576 B2 * 6/2022 DeLaney ..... B01D 3/40
2008/0185316 A1 * 8/2008 Respini ..... C10G 9/00 208/48 Q
2011/0005970 A1 * 1/2011 Ou ..... C10G 51/04 208/44
2013/0264246 A1 10/2013 Holtzer
2014/0061095 A1 * 3/2014 Beech, Jr. ..... C10G 69/06 208/73
2014/0061100 A1 * 3/2014 Lattner ..... C10G 31/06 208/48 Q
2015/0344785 A1 * 12/2015 Soultanidis ..... C10G 45/72 208/44
2015/0368570 A1 * 12/2015 Beech, Jr. ..... C10G 45/02 208/143
2016/0122667 A1 * 5/2016 Evans ..... C10G 9/36 208/70
2018/0057759 A1 * 3/2018 Kandel ..... C10G 69/06
2018/0171239 A1 * 6/2018 Chen ..... C10G 1/02
2019/0016975 A1 * 1/2019 Coleman ..... C10G 69/06
2020/0071626 A1 * 3/2020 Kandel ..... C10G 47/24
2020/0377808 A1 * 12/2020 Evans ..... C10G 49/04
2021/0348064 A1 * 11/2021 Kandel ..... C10G 29/20

OTHER PUBLICATIONS

Liu, Z.; Phillips, J. B. J. Chromatogr. Sci . . . 1991, 29, 227-231.
Manzano, C.; Hoh, E.; Simonich, S. L. M. J. Chrom. A., 2013, 1307, 172-179.
Marriott, P. J.; Massil, T.; Huegel, H. J. Sep. Sci. 2004, 27, 1273-1284.
Tranchida, P.Q., Purcaro, G., Dugo, P., Mondello, L., TrAC Trends Anal. Chem. 2011 30, 1437-1461.
Wang, F. C.-Y.; Qian, K.; Green, L. A. Anal. Chem. 2005, 77, 2777-2785.
Mondello, L., Tranchida, Q.P., Dugo, P., Dugo, G. Mass Spec. Rev. 2008 27, 101-124.
Badertscher, M.; Bischofberger, K.; Munk, M.E.; Pretsch, E. J. Chem. Info. Model. 2001, 41, 889-893.
Mennito, A. S.; Qian, K. Energy & Fuels. 2013, 27, 7348-7353.

* cited by examiner

STEAM CRACKING PROCESSES AND THE USE OF SOLVENTS STREAMS PRODUCED BY SOLVENT-ASSISTED TAR CONVERSION PROCESSES

PRIORITY CLAIM

Cross-Reference of Related Applications

This application is a National Phase Application of PCT Application Serial No. PCT/US2019/041003 having an international filing date of Jul. 9, 2019, which claims priority to and the benefit of U.S. Provisional Patent Application No. 62/716,754, filed Aug. 9, 2018, and European Patent Application No. 18200309.5 which was filed Oct. 15, 2018, the disclosures of all of which are incorporated by reference herein in their entireties.

FIELD

This disclosure relates to processes for pyrolysis, such as steam cracking.

This disclosure also relates to methods for using a steam cracker product, e.g., as a hydrogen donating solvent to reduce reactor fouling.

BACKGROUND

Pyrolysis processes, such as steam cracking, are utilized for converting saturated hydrocarbons to higher-value products such as light olefins, e.g., ethylene and propylene. Besides these products, pyrolysis can also produce a significant amount of relatively low-value heavy products, such as pyrolysis tar. Pyrolysis tar is a high-boiling, viscous, reactive material comprising complex, ringed, and branched molecules that can polymerize and foul equipment. Pyrolysis tar also contains high molecular weight non-volatile components including paraffin insoluble compounds, such as pentane-insoluble compounds and heptane-insoluble compounds. When the pyrolysis is steam cracking, the pyrolysis tar is identified as steam-cracker tar ("SCT").

One difficulty encountered when steam cracking is the reactive composition of a steam cracker effluent produced during steam cracking. The steam cracker effluent contains a significant amount of reactive free radicals formed by high temperature pyrolysis of hydrocarbons. During processing, various effluent product streams are produced, and as the streams cool, most of the reactive radicals in the streams react to form stable products. However, some radicals survive and act as initiators for olefin polymerization in areas of significant residence time such as in separation equipment (e.g., a primary fractionator) and in tar knockout drums.

In typical steam cracking quench systems, a quench oil composition, which contains significant amounts of free radicals, is taken from a primary fractionator as a cut at about 180° C. The quench oil composition is then input into an effluent line flowing from a pyrolysis reactor/furnace. In some quench systems, the effluent line flowing from the pyrolysis reactor/furnace includes a heat exchanger that acts to recover heat from the effluent flowing from the pyrolysis reactor/furnace prior to contacting the quench oil composition. Upon adding the quench oil composition to the effluent line flowing from the pyrolysis reactor/furnace, the effluent cools but fouling precursors (e.g., radicals, vinyl aromatics and other comonomer species) remain in the effluent. The fouling precursors lead to fouling in downstream process equipment or in tar processing reactors.

There is a need to mitigate fouling in downstream processing equipment in a steam cracker. There is also a need to identify the compositional makeup of various effluent streams (e.g., the SCT), and to identify the compounds causing reactor fouling for identification before fouling occurs.

SUMMARY

In an embodiment, a method for decreasing reactor fouling in a steam cracking process is provided. The method includes steam cracking a hydrocarbon feed to obtain a quench oil composition comprising a concentration of donatable hydrogen of 0.5 wt. % or more based on a total weight percent of the quench oil composition; exposing a steam cracker effluent flowing from a pyrolysis furnace to the quench oil composition to form a mixture; and fractionating the mixture in a separation apparatus to obtain a steam cracker tar.

In another embodiment, a process effluent composition is provided, such as a hydroprocessed steam cracker effluent composition. The process effluent composition includes one or more compounds classes of the formula (I-1)

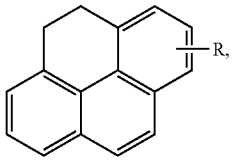

(I-2)

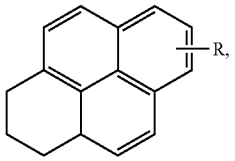

(I-3)

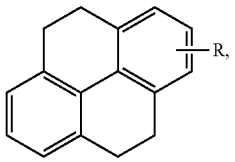

(I-4)

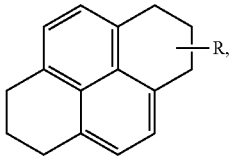

(I-5)

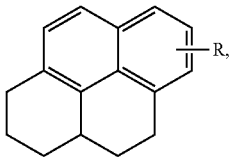

(I-6)

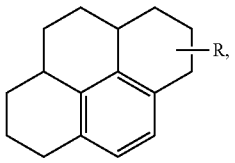

-continued (I-7)

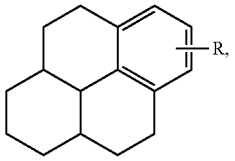

(II-1)

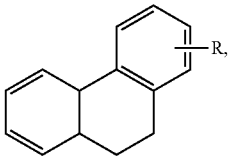

(II-2)

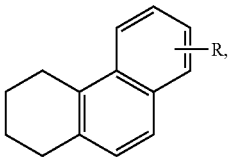

(II-3)

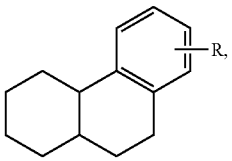

(II-4)

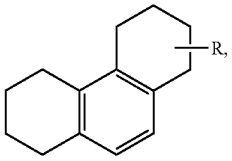

(III-1)

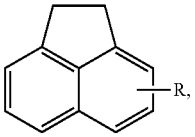

(III-2)

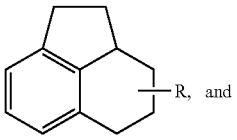

(IV-1)

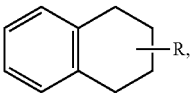

wherein: R is one or more R groups, wherein each R group is a $C_1$ to $C_{10}$ alkyl radical.

In other embodiments, a hydrocarbon mixture is provided. The hydrocarbon mixture includes a mid-cut composition which comprises one or more hydrocarbon compounds having a normal boiling point in the range of from 93° C. (200° F.) to 538° C. (1000° F.), e.g., 121° C. (250° F.) to 427° C. (800° F.), such as 149° C. (300° F.) to 371° C. (700° F.). The hydrocarbon mixture is useful as a flux and/or solvent and/or heat transfer fluid for industrial processes and end uses, such as for mechanical, electrical, and chemical or petrochemical processes or end uses, including use in heavy oil processing.

Systems and apparatus for carrying out any of the foregoing processes are also within the scope of the invention.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, for the disclosure may admit to other equally effective embodiments.

DETAILED DESCRIPTION

Figure 1:
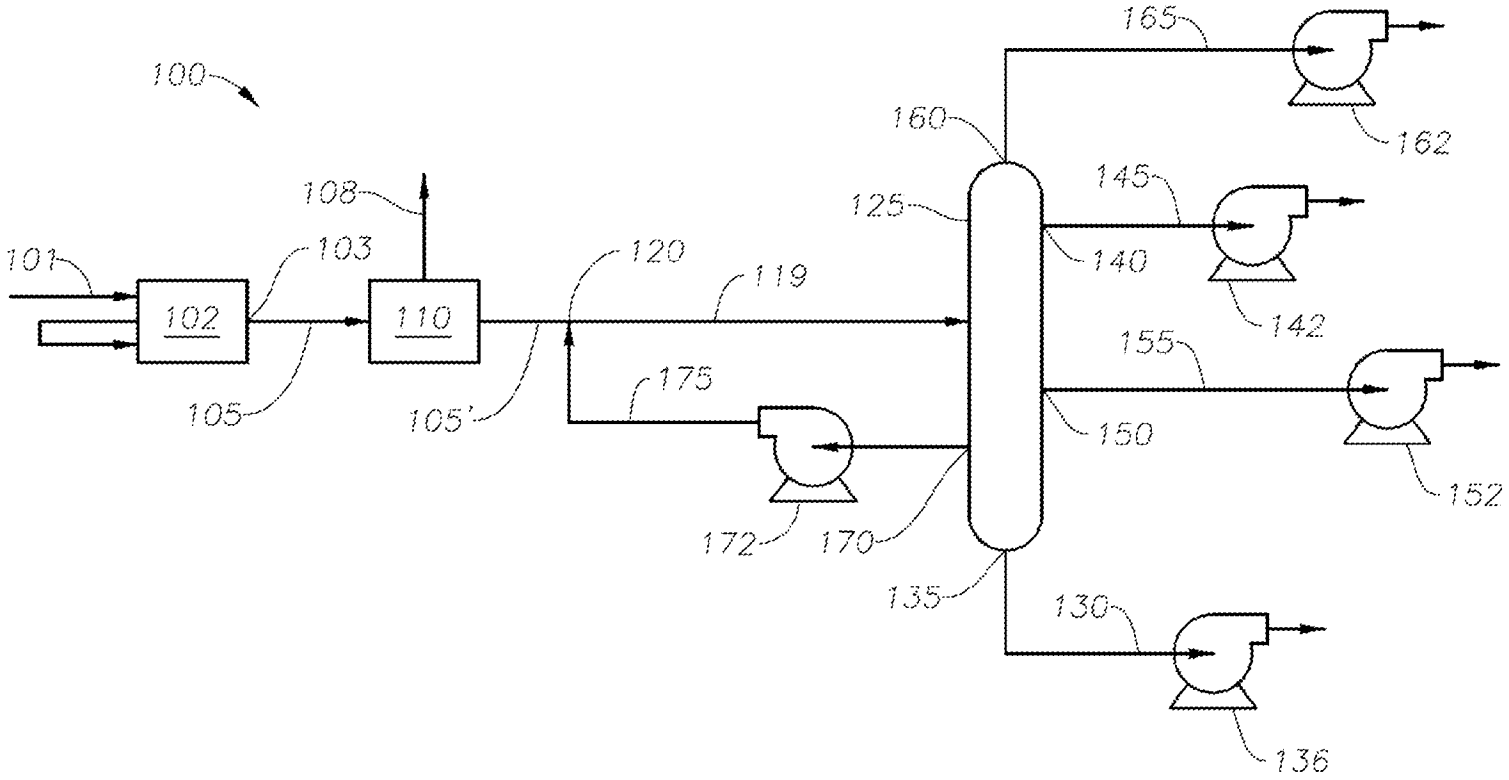
FIG. 1 schematically illustrates a conventional steam cracking process.

The present disclosure relates to processes and apparatus for decreasing primary fractionator fouling in steam cracking processes. Specifically, the disclosure relates to (a) the use of (i) a quench oil composition (e.g., a hydroprocessed tar or a total liquids product ("TLP") and/or (ii) a mid-cut produced from a solvent-assisted tar conversion ("SATC") process(es), e.g., for use as a hydrogen donating solvent in steam cracking processes; and (b) the separation, identification, and quantification of the mid-cut (produced from the SATC process) by GC×GC×MS. The term "TLP" means that portion of the SATC product subsisting in the liquid phase under SATC process conditions at the outlet of the SATC reactor. GC×GC means "comprehensive" two-dimensional gas chromatography, which is comprehensive in the sense that each gas chromatography data point is collected in a 2-dimensional way. The term GC×GC×MS means GC×GC and using mass spectrometry as an additional separation tool. It should be noted that the SATC process is a hydrotreatment process, so the disclosure can be applied to hydrotreatment processes generally.

Fouling in reactors, fractionators, and other areas of chemical and refinery plants can occur via a variety of mechanisms, including polymerization. For example, polymerization of conjugated unsaturated hydrocarbons is responsible for fouling in cracking and hydrogenation processes due to reactive material and operating condition deviations. In many cases, the mechanism of fouling can be determined based on an analysis of fouling materials in conjunction with process evaluations. In a steam cracker's primary fractionator, vinyl aromatic hydrocarbons and their associated heteroatom species (collectively "vinyl aromatics" or "vinyl aromatic species") are the primary monomers involved in fouling. Vinyl aromatics are a group of molecules with double bonds either in the side chains and/or in unsaturated aromatic rings. In cracked stream processes, nearly all of the vinyl aromatics (i.e., fouling precursors) are typically present in the naphtha and mid-distillate boiling point ranges, such as the molecular classes of styrenes, divinylbenzenes, indenes, dihydronaphthalenes, vinylnaphthalenes, and divinylnaphthalenes.

Concentrations of the divinylnaphthalene molecular class and the styrene molecular class, examples of which are shown below, in the steam cracked gas oil can be more than 0.45 wt. % and 3.5 wt. %, respectively, as determined by GC×GC×MS (such as GC×GC-Flame Ionization Detection ("FID") and by GC×GC-Field Ionization Mass Spectrometry ("FIMS")) described below.

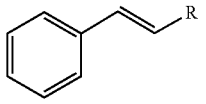

Styrenes

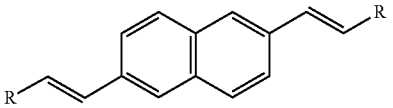

Divinylnaphthalenes where R is an alkyl radical.

The terms "alkyl radical", "alkyl", "hydrocarbyl radical," "hydrocarbyl," and "hydrocarbyl group," are used interchangeably throughout this document. Likewise, the terms "group," "radical," and "substituent" are also used interchangeably in this document. For purposes of this disclosure, "hydrocarbyl radical" refers to $C_1$-$C_{20}$ radicals, that may be linear, branched, or cyclic, and when cyclic, aromatic or non-aromatic. Examples of such radicals include methyl, ethyl, n-propyl, isopropyl, n-butyl, isobutyl, sec-butyl, tert-butyl, pentyl, iso-amyl, hexyl, octyl cyclopropyl, cyclobutyl, cyclopentyl, cyclohexyl, cyclooctyl, and the like including their substituted analogues.

It is contemplated that the three dimensional separation, GC×GC×MS, as described below, can be performed on any GC×GC×MS where the MS has field ionization or similar capability.

I. Steam Cracking

The disclosure is not limited to any particular forms of steam cracking or to particular hydrocarbon feeds to the steam cracking process.

Steam cracking is typically carried out by exposing a steam cracker feed to a temperature≥400° C. in at least one steam cracker furnace operating under thermal pyrolysis conditions. The steam cracker feed is typically a mixture comprising steam and a hydrocarbon feed. During the steam cracking process, at least a portion of the hydrocarbon feed reacts in the presence of the steam to produce a steam cracker effluent comprising light olefin, light saturated compounds, steam cracker naphtha ("SCN"), steam cracker gas oil ("SCGO"), and steam cracker tar. SCN, SCGO, and steam cracker tar are separated from light hydrocarbon vapor in a primary fractionator, which is subject to undesirable fouling. Embodiments herein lessen or even substantially eliminate this fouling, which will now be described in more detail.

Disclosed herein is a steam cracking process employing a quench oil composition (e.g., a mid-cut, a hydroprocessed tar, and/or a TLP) at various inputs to a steam cracking process. Use of the quench oil composition has various benefits including mitigating steam cracker fouling. Although the disclosure focuses on use of the mid-cut solvent (or the "mid-cut") in a quench oil composition in Section I, other quench oil compositions comprising effluent streams during steam cracking are contemplated. For example, the quench oil composition can comprise at least a portion of one or more of (i) the entire effluent from a SATC process, (ii) the entire effluent from a SATC process after contaminant (mainly $H_2S$) removal, (iii) TLP, and (iv) hydroprocessed tar.

Like the mid-cut, the hydroprocessed tar and the TLP are produced during a SATC process, such as the SATC processes described in U.S. Patent Application Publication Nos. 2018/0057759 and 2019/0016975 which are incorporated by reference herein in their entireties.

The various solvent streams (e.g., hydroprocessed tar, TLP, and mid-cut) produced during hydrotreatment processes (e.g., SATC processes) have been discovered to be good hydrogen donor solvents. By replacing a typical quench oil with one or more of these solvent streams, e.g., the mid-cut from a hydrotreatment process, the residual reactive radicals are captured by species within the mid-cut that donate hydrogen to the reactive radicals. As a result, the amount of free radical initiators is reduced (or eliminated), thereby mitigating olefin polymerization and minimizing or eliminating primary fractionator fouling.

The mid-cut comprises partially hydrogenated 2-4 ring molecules, such as dihydroanthracene and tetralin. These molecules can readily transfer hydrogen radicals to reactive free radicals in steam cracker effluent (flowing from a pyrolysis furnace) to make stable products. An exemplary equation for the radical transfer is shown below:

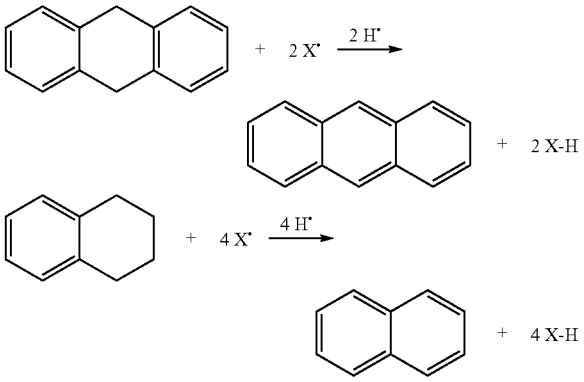

where X• refers to a radical species, and H• refers to a hydrogen radical. As described below, tar is hydroprocessed in a SATC unit. Because the SATC unit generates excess solvent (i.e., the mid-cut), the mid-cut can be used as a quench oil to quench the effluent flowing from a pyrolysis furnace and/or a transfer line exchanger ("TLE"). The relatively high temperature during quench facilitates hydrogen transfer from the mid-cut to the free radicals. The mid-cut can also be used to mix with various effluent streams flowing from a separation apparatus (e.g., a primary fractionator). The concentration of the donatable hydrogen in a sample of mid-cut is determined by the following experiment.

Experiment 1: To a 20 mL scintillation vial in a glovebox is added the DDQ (2.7 mmol) and about 8 mL toluene. With rapid stirring, hydrotreated mid-cut from the SATC (about 100 mg) is added solution of DDQ. The vial is then sealed, and heated at about 110° C. for about 1 hour, during which time a precipitate forms. The heating is cut off, the vial is opened, and 9,10-dihydroanthracene (2.7 mmol) in ~3 mL toluene is added to the vial. The vial is then sealed and heated at about 110° C. for about 2 hours, during which time more precipitate forms. After 2 hours, an aliquot of the mixture is taken, filtered through a glass frit to remove a solid residue, and the filtrate is retrieved. The filtrate is analyzed by GCMS for % composition of 9,10-dihydroanthracene and anthracene to determine the wt. % of hydrogen donatable by the mid-cut. The GC analyses of two duplicate samples give an average wt. % of donatable hydrogen to DDQ=2.82±0.18% based on the total weight of the mid-cut. This experiment shows that the mid-cut is very effective as a hydrogen donating solvent.

Given that a major amount (e.g., ≥50 wt. %, such as ≥75 wt. %, or ≥90 wt. %) of the mid-cut from a SATC process is a hydrogen donor solvent, the boiling point range of the stream used for quenching the effluent flowing from the TLE can be tuned to increase (or even maximize) quench rate and/or to make up the amount needed for quench. The boiling point range (namely the range of normal points) of mid-cut used for quench is from about 300° F. to about 700° F. (from about 150° C. to about 370° C.).

According to certain embodiments, a method for decreasing reactor fouling in a steam cracking process includes steam cracking a first hydrocarbon feed to obtain a quench oil composition (e.g., hydroprocessed tar, TLP, and/or mid-cut); exposing a second hydrocarbon feed (e.g., a steam cracker effluent flowing from a pyrolysis furnace) to the quench oil composition (or a portion of the quench oil composition) to form a mixture; and fractionating the mixture in a separation apparatus to obtain a steam cracker tar (SCT).

In certain embodiments, the quench oil composition (e.g., hydroprocessed tar, TLP, and/or mid-cut), or at least a portion of the quench oil composition, can be added to a hydrocarbon feed (e.g., a steam cracker effluent flowing from a pyrolysis furnace) at a quench point located both downstream of pyrolysis furnace and/or a transfer line exchanger and upstream of a separation apparatus. The separation apparatus can be a conventional primary fractionator and associated equipment, e.g., those described in U.S. Pat. No. 8,083,931, which is incorporated by reference herein in its entirety. In some embodiments, the quench oil composition, or at least a portion of the quench oil composition, can be added to an effluent flowing from a separation apparatus at one or more mixing points located downstream of the separation apparatus.

In various aspects, the steam cracking process includes a SATC process. The SATC process is designed to convert tar, which may be a steam cracked tar or result from another pyrolysis process, such as biomass pyrolysis tar or coal pyrolysis tar, into lighter products similar to fuel oil. In some cases, it is desirable to further upgrade the tar to increase the content of compounds having normal boiling points in the distillate range. SATC processes are proven to be effective for drastic viscosity reduction from as high as about 500,000 cSt to about 15 cSt at 50° C. with more than about 90% sulfur conversion. The prominent reaction types in a SATC process are hydrocracking, hydrodesulfurization, hydrodenitrogenation, thermal cracking, hydrogenation, and oligomerization reactions.

Representative SATC processes are described in U.S. Patent Application Publication No. 2019/0016975 and in P.C.T. Patent Application Publications Nos. WO2018/111577 and WO2018/111574; each of which is incorporated by reference herein in their entireties. Although typical for SATC processes have at least two stages for hydroprocessing SCT, SATC processes having one stage for SCT hydroprocessing are also within the scope of the invention. Representative SATC processes having one stage for SCT hydroprocessing are described in, e.g., U.S. Pat. No. 9,777,227, which is incorporated by reference herein in its entirety.

A typical SATC process includes: (a) hydroprocessing a feedstock (e.g., a steam cracker effluent or an effluent flowing from a separation apparatus) comprising pyrolysis tar in a first hydroprocessing zone by contacting the hydrocarbon feed with at least one hydroprocessing catalyst in the presence of a utility fluid and molecular hydrogen under catalytic hydroprocessing conditions to convert at least a portion of the hydrocarbon feed to a first hydroprocessed product; (b) separating from the first hydroprocessed product in one or more separation stages: (i) an overhead stream comprising ≥about 1.0 wt. % of the first hydroprocessed product, (ii) a mid-cut stream comprising ≥about 20 wt. % of the first hydroprocessed product, and (iii) a bottoms stream comprising ≥about 20 wt. % of the first hydroprocessed product; (c) recycling at least a portion of the mid-cut stream for use as a utility fluid in the first hydroprocessing zone; and (d) hydroprocessing at least a portion of the bottoms stream in a second hydroprocessing zone by contacting the bottoms stream with at least one hydroprocessing catalyst in the presence of molecular hydrogen under catalytic hydroprocessing conditions to convert at least a portion of the bottoms stream to a second hydroprocessed product. The multi-stage configuration provides a second stage (or final stage if more than two hydroprocessing stages are used) hydroprocessed product that has a sulfur content of about 1.5 wt. % or less, such as about 1.0 wt. % or less, or about 0.5 wt. % or less based on the total weight of the second hydroprocessed product. In this description, the recycled stream is referred to as a mid-cut separated from a first hydroprocessed product. Although separation of an overhead stream, the mid-cut stream and a bottoms stream can be carried out in one separations stage (e.g., in a fractionator), as described, e.g., in P.C.T. Patent Application Publication Nos. WO2018/111577 and WO2018/111574, carrying out these separations in two or more stages is also within the scope of the invention, as described, e.g., in U.S. Patent Application Publication No. 2019-0016975.

A. Hydrocarbon Feeds

In certain aspects, the hydrocarbon feed comprises relatively high molecular weight hydrocarbons ("Heavy Hydrocarbon"), such as those which produce a relatively large amount of SCN, SCGO, and steam cracker tar during steam cracking. The Heavy Hydrocarbon typically comprises $C_{5+}$ hydrocarbon, which for example include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, crude oil, atmospheric pipestill bottoms, vacuum pipestill streams including bottoms, gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon feed can have a nominal final boiling point of at least about 600° F. (about 315° C.), generally greater than about 750° F. (about 399° C.), typically greater than about 850° F. (about 454° C.), for example greater than about 950° F. (about 510° C.). Nominal final boiling point means the temperature at which about 99.5 weight percent of a particular sample has reached its boiling point. The hydrocarbon feed can comprise ≥about 1 wt. % of Heavy Hydrocarbon, based on the weight of the hydrocarbon feed, e.g., ≥about 25 wt. %, such as ≥about 50 wt. %, or ≥about 75 wt. %, or ≥about 90 wt. %, or ≥about 99 wt. %.

In other aspects, the hydrocarbon feed comprises one or more relatively low molecular weight hydrocarbon (Light Hydrocarbon), such as one or more of ethane, propane and butanes. The relative amounts of Light Hydrocarbon (typically in the vapor phase) and Heavy Hydrocarbon (typically in the liquid phase) in the hydrocarbon feed can range from about 100% (weight basis) Light Hydrocarbon to about 100% (weight basis) Heavy Hydrocarbon, although typically there is at least about 1 wt. % Light Hydrocarbon present in the hydrocarbon feed. For example, the hydrocarbon feed can comprise ≥about 1 wt. % of Light Hydrocarbon, based on the weight of the hydrocarbon feed, e.g., ≥about 25 wt. %, such as ≥about 50 wt. %, or ≥about 75 wt. %, or ≥about 90 wt. %, or ≥about 99 wt. %. Although hydrocarbon feeds comprising Light Hydrocarbon typically produce a greater yield of $C_2$ unsaturates (ethylene and acetylene) than do hydrocarbon feeds comprising Heavy Hydrocarbon, the steam cracking Light Hydrocarbon also produces less SCN, SCGO, and steam cracker tar. Light Hydrocarbon typically includes substantially saturated hydrocarbon molecules having fewer than five carbon atoms, e.g., ethane, propane, and mixtures thereof (e.g., ethane-propane mixtures or "E/P" mix). For ethane cracking, a concentration of at least about 75% by weight of ethane is typical. For E/P mix, a concentration of at least about 75% by weight of ethane plus propane is typical, the amount of ethane in the E/P mix being ≥about 20.0 wt. % based on the weight of the E/P mix, e.g., in the range of about 25.0 wt. % to about 75.0 wt. %. The amount of propane in the E/P mix can be, e.g., ≥20.0 wt. %, based on the weight of the E/P mix, such as in the range of about 25.0 wt. % to about 75.0 wt. %.

The steam cracking process can be configured to utilize a hydrocarbon feed comprising Heavy Hydrocarbon during a first time interval and then utilizes a hydrocarbon feed comprising Light Hydrocarbon during a second time interval. This can be carried out while maintaining the mass flow rate of hydrocarbon feed to the steam cracking process substantially constant during the first and second periods, e.g., by substituting a Light Hydrocarbon for a portion of the Heavy Hydrocarbon in the hydrocarbon feed. For example, during the first time interval, the hydrocarbon feed comprises ≥about 50% (weight basis, based on the weight of hydrocarbon feed) of Heavy Hydrocarbon, e.g., ≥about 75%, such as ≥about 90%, or ≥about 99%, with the balance (if any) being comprised of Light Hydrocarbon. During the second time interval, the hydrocarbon feed comprises ≥about 50% (weight basis, based on the weight of hydrocarbon feed) of Light Hydrocarbon, e.g., ≥about 75%, such as ≥about 90%, or ≥about 99%, with the balance (if any) being comprised of Heavy Hydrocarbon. Optionally, the weight of hydrocarbon feed introduced into the steam cracker is substantially constant during the first and second time intervals, e.g., varies by no more than about +/−50% (weight basis), such as about +/−25%, or about +/−10%. Although shorter durations can be used, the durations of the first and second time intervals are each typically ≥about 24 hours, e.g., ≥about 1 week, such as ≥about 1 month, or ≥about 1 year. For example, the duration of the first time interval and/or the duration of the second time interval can be in the range of from about 1 day to about 1 year, e.g., about 1 week to about 6 months.

For purposes of the present disclosure, the term "pyrolysis tar" refers to (a) a mixture of hydrocarbons having one or more aromatic components and optionally (b) non-aromatic and/or non-hydrocarbon molecules, the mixture being derived from hydrocarbon pyrolysis, with at least about 70% of the mixture having a boiling point at atmospheric pressure that is ≥about 550° F. (about 290° C.). Certain pyrolysis tars have an initial boiling point≥about 200° C. For certain pyrolysis tars, ≥about 90.0 wt. % of the pyrolysis tar has a boiling point at atmospheric pressure≥about 550° F. (about 290° C.). The pyrolysis tar can comprise, e.g., ≥about 50.0 wt. %, e.g., ≥about 75.0 wt. %, such as ≥about 90.0 wt. %, based on the weight of the pyrolysis tar, of hydrocarbon molecules (including mixtures and aggregates thereof) having (i) one or more aromatic components and (ii) a number of carbon atoms≥about 15. Pyrolysis tar generally has a metals content, ≤about $1.0\times10^3$ ppmw, based on the weight of the pyrolysis tar, which is an amount of metals that is far less than that found in crude oil (or crude oil components) of the same average viscosity.

For purposes of the present disclosure, "SCT" refers to pyrolysis tar obtained from steam cracking, also referred to as steam-cracker tar. "Biomass pyrolysis tar" refers to pyrolysis tar obtained from thermal cracking of biomass. "Coal pyrolysis tar" refers to pyrolysis tar obtained from thermal cracking of hydrocarbons derived from coal.

For purposes of the present disclosure, "mid-cut" refers to the boiling point range cut (by distillation) from the TLP produced from SATC process(es).

Effluent from a stage for catalytically hydroprocessing SCT (or a pretreated SCT, as described in WO2018/111577 and WO2018/111574) in the presence of molecular hydrogen and a utility fluid typically contains material that is in the vapor phase at the stage's outlet and material that is in the liquid phase at that location, and may also contain some solid material, e.g., particulates. The TLP is that part of the effluent that is in the liquid phase at the stage's outlet. In other words, the TLP is the liquid-phase part of the hydroprocessing stage effluent under process conditions that exist at the outlet of the hydroprocessing stage.

For purposes of the present disclosure, "Tar Heavies" (TH) refers to a product of hydrocarbon pyrolysis, the TH having an atmospheric boiling point≥about 565° C. and comprising ≥about 5.0 wt. % of molecules having a plurality of aromatic cores based on the weight of the product. The TH are typically solid at about 25.0° C. and generally include the fraction of SCT that is not soluble in a 5:1 (vol.:vol.) ratio of n-pentane:SCT at about 25.0° C. TH generally include asphaltenes and other high molecular weight molecules.

B. Steam Cracking Process Conditions

In aspects which include hydroprocessing steam cracker tar, the steam cracking can be carried out in at least one steam cracking furnace which includes radiant and convection sections. Fired heaters (e.g., burners) are located in the radiant section, and flue gas from combustion carried out with the fired heaters travel upward from the radiant section, through the convection section, and then away from the steam cracker furnace's flue gas outlet. The hydrocarbon feed is typically preheated by indirect exposure to the flue gases in the convection section. The pre-heated hydrocarbon feed is then combined with steam to produce the steam cracker feed. The steam cracker feed is typically subjected to additional pre-heating in the convection section. The pre-heated steam cracker feed is then transferred to the radiant section, where the steam cracker feed is indirectly exposed to the combustion carried out by the burners.

The steam cracker feed typically comprises steam in an amount in the range of from about 10.0 wt. % to about 90.0 wt. %, based on the weight of the hydrocarbon+steam mixture, with the remainder comprising (or consisting essentially of, or consisting of) the hydrocarbon feed. In certain aspects, the weight ratio of steam to hydrocarbon feed is in the range of from about 0.1 to about 1.0, e.g., a ratio of about 0.2 to about 0.6.

Steam cracking conditions typically include, e.g., exposing the steam cracker to a temperature (measured at the radiant section's pyrolysis product outlet)≥about 400° C., e.g., in the range of about 400° C. to about 900° C., and a pressure≥about 0.1 bar, for a steam cracking residence time in the range of from about 0.01 second to about 5.0 seconds.

In certain aspects, the hydrocarbon feed comprises ≥about 50% (weight basis, based on the weight of hydrocarbon feed) of Heavy Hydrocarbon, and steam cracker feed comprises about 0.2 to about 1.0 kg steam per kg hydrocarbon. The balance of the hydrocarbon feed can be Light Hydrocarbon, for example. In these aspects, the steam cracking conditions generally include one or more of (i) a temperature in the range of about 760° C. to about 880° C.; (ii) a pressure in the range of from about 1.0 to about 5.0 bar (absolute), or (iii) a cracking residence time in the range of from about 0.10 to about 2.0 seconds. The steam cracker effluent at the radiant coil outlet typically has a temperature in the range of about 760° C. to about 880° C., e.g., about 790° C. (about 1450° F.).

In other aspects, the hydrocarbon feed comprises ≥about 50% (weight basis, based on the weight of hydrocarbon feed) of Light Hydrocarbon, and the steam cracker feed comprises about 0.2 to about 0.5 kg steam per kg hydrocarbon. The balance of the hydrocarbon feed can be Heavy Hydrocarbon, for example. In these aspects, the steam cracking conditions generally include one or more of (i) a temperature in the range of about 760° C. to about 1100° C.; (ii) a pressure in the range of from about 1.0 to about 5.0 bar (absolute), or (iii) a cracking residence time in the range of from about 0.10 to about 2.0 seconds. The steam cracker effluent at the radiant coil outlet typically has a temperature in the range of about 760° C. to about 1100° C., e.g., about 900° C. (about 1650° F.) for ethane or propane feeds.

C. Quench Oil Composition

It has been discovered that a quench oil composition (i.e., a solvent stream produced during a hydrotreatment process, such as, a hydroprocessed tar, a TLP, and/or a mid-cut) with improved compatibility with the tar (e.g., pyrolysis tar such as steam cracker tar) can be used to mitigate fouling in processing equipment, particularly in transfer lines, reactors, and separations equipment.

In certain embodiments, the quench oil composition comprises a concentration of donatable hydrogen of about 0.5 wt. % or more, such as about 1.0 wt. % or more, such as about 1.5 wt. % or more, such as about 2.0 wt. % or more, such as about 2.5 wt. % or more, based on a total weight percent of the quench oil composition. The compositional make-up of the quench oil composition is described in more detail below.

In certain embodiments, the quench oil composition includes the total solvent output produced during a hydrotreatment process, e.g. during a SATC process. In another embodiment, the quench oil composition includes the total solvent output minus the $H_2S$ produced during a SATC process. In another embodiment, the quench oil composition includes the hydroprocessed tar produced during a SATC process. In another embodiment, the quench oil composition includes the TLP produced during a SATC process. In another embodiment, the quench oil composition includes the mid-cut produced during a SATC process. In another embodiment, the quench oil composition includes one or more of the aforementioned solvent streams produced during a SATC process.

In certain embodiments, the quench oil composition comprises TLP from one or more of the first hydroprocessing zone and the second hydroprocessing zone. The first and second hydroprocessing zones are described in, e.g., U.S. Patent Application Publication No. 2019/0016975, and in P.C.T Patent Applications Nos. WO2018/111574 and WO2018/111577.

In certain embodiments, the boiling point range of hydroprocessed tar used for a quench oil (and/or for mixing with an effluent stream such as the primary fractionator bottoms, e.g., the SCT) is from about 50° F. to about 1400° F. (from about 10° C. to about 760° C.).

In certain embodiments, the normal (true, atmospheric pressure) boiling point range of TLP used for a quench oil (and/or for mixing with an effluent stream such as the primary fractionator bottoms, e.g., the SCT) is in a range of from about 100° F. to about 1400° F. (from about 38° C. to about 760° C.). For example, the TLP normal boiling point range can be from about 93° C. (200° F.) to 538° C. (1000° F.), e.g., 121° C. (250° F.) to 427° C. (800° F.), such as 149° C. (300° F.) to 371° C. (700° F.). Normal boiling point distributions can be determined, e.g., by conventional methods such as the method of ASTM D7500. When the final boiling point is greater than that specified in the standard, the normal boiling point distribution can be determined by extrapolation. Typically, the TLP has an ASTM D86 10% distillation point≥60° C. and a 90% distillation point≤425° C., e.g., ≤400+° C., such as ≤360° C. When the 10% or 90% distillation points are outside the range specified in the standard, they can be determined by extrapolation.

At least a portion of the quench oil composition (e.g., one or more of hydroprocessed tar, TLP, and mid-cut) is used as a quench oil composition at a quench location that is downstream of a pyrolysis furnace and/or transfer line exchanger(s) and upstream of a separation apparatus (e.g., primary fractionator, tar knock-out drum, etc.). Alternatively or in addition, the quench oil composition can be mixed with one or more effluents flowing from the separation apparatus (e.g., primary fractionator) such as those effluents flowing through an SCT line. The mixing can be carried out at one or more mixing locations downstream of the separation apparatus, In certain aspects, ≥about 20 wt. %, ≥about 30 wt. %, ≥about 40 wt. %, ≥about 50 wt. %, ≥about 60 wt. %, ≥about 70 wt. %, ≥about 80 wt. % of one or more of (i) a mid-cut from an SATC process, (ii) a hydroprocessed tar, and (iii) a TLP from a SATC process is recycled for use as a quench oil composition at one or more of these quench locations and/or misusing locations.

In one or more embodiments, at least a portion of the quench oil composition is combined with at least a portion of the pyrolysis effluent (e.g., the effluent flowing from the pyrolysis furnace and/or transfer line exchanger(s)) to produce a quenched mixture. The quenched minute can be conducted to additional separation stages, e.g., one or more tar knock-out drums, one or more fractionators, one or more quench towers, etc.

In certain aspects, the quenched mixture comprises, consists essentially of, or even consists of first and second components. The first component can be, e.g., one or more of (i) a pyrolysis effluent from a steam cracking furnaces, (ii) a cooled pyrolysis effluent from a TLE, (iii) a tar knock-out drum feed, (iv) a tar knock-out drum overhead stream, and (iv) a tar knock-out drum bottoms stream (typically comprising, consisting of, or consisting essentially of SCT). The second component is typically a quench oil composition, e.g., one comprising, consisting essentially of, or consisting of one or more of (i) a mid-cut from an SATC process, (ii) a hydroprocessed tar, and (iii) a TLP from a SATC process.

For example, the quenched mixture can comprise, e.g., (i) about 90.0 wt. % to about 10.0 wt. % of the first component and about 10.0 wt. % to about 90.0 wt. % of the second component, or (ii) about 90.0 wt. % to about 20.0 wt. % of the first component and about 10.0 wt. % to about 80.0 wt. % of the second component, or (iii) from about 90.0 wt. % to about 40.0 wt. % of the first component and from about 10.0 wt. % to about 60.0 wt. % of the second component, the weight percent being based on the weight of the quenched mixture. One typical quenched mixture comprises, e.g., (i) about 20.0 wt. % to about 90.0 wt. % of a pyrolysis effluent (or cooled pyrolysis effluent) and about 10.0 wt. % to about 80.0 wt. % of a quench oil composition, or (ii) from about 40.0 wt. % to about 90.0 wt. % of the pyrolysis effluent (or cooled pyrolysis effluent) and from about 10.0 wt. % to about 60.0 wt. % of the quench oil composition, the weight percent being based on the weight of the quenched mixture. Another typical quenched mixture comprises e.g., (i) about 20.0 wt. % to about 90.0 wt. % of a tar stream separated from the pyrolysis effluent (or cooled pyrolysis effluent) and about 10.0 wt. % to about 80.0 wt. % of the quench oil composition, or (ii) from about 40.0 wt. % to about 90.0 wt. % of the tar stream and from about 10.0 wt. % to about 60.0 wt. % of the quench oil composition, the weight percent being based on the weight of the quenched mixture.

In certain aspects SCT is separated upstream of a primary fractionator. For example, the SCT can be separated from one or more of the pyrolysis effluent, the cooled pyrolysis effluent (e.g., from a TLE), a partially-quenched mixture (e.g., the mixture in line 105' between points 120 and 220, and the quenched mixture. In these aspects, the primary fractionator bottoms typically has a normal boiling point range that is less than that of SCT, e.g., in a quench oil bowling range. In these aspects, at least a portion of the primary fractionator bottoms can be introduced into the pyrolysis effluent and/or cooled pyrolysis effluent for additional quenching. A quench oil composition can be added to the partially-quenched mixture, wherein the quench oil composition comprises one or more of (i) a mid-cut from an SATC process, (ii) a hydroprocessed tar, and (iii) a TLP from a SATC process. Alternatively or in additions, the quench oil composition is introduced upstream of the location at which the primary fractionator bottoms is introduced. In these aspects, the second component of the quenched mixture comprises primary fractionator bottoms and one or more of (i) a mid-cut from an SATC process, (ii) a hydroprocessed tar, and (iii) a TLP from a SATC process. For example, the second component can comprise 1 wt. % to 90 wt. % of primary fractionator bottoms, with ≥90 wt. % of the balance of the second component being one or more of (i) a mid-cut from an SATC process, (ii) a hydroprocessed tar, and (iii) a TLP from a SATC process; such as 5 wt. % to 85 wt. % of the second component, or 10 wt. % to 75 wt. %. In these and other aspects, a side product cut withdrawn from the primary fractionator above the bottoms region (e.g., a region immediately above the bottoms regions) can be substituted for at least a part of the primary fractionator bottoms. Those skilled in the art will appreciate that depending on the tar drum operating conditions and those of the primary fractionator, the primary fractionator bottoms and/or the side product can have a normal boiling point range of about 93° C. (200° F.) to 538° C. (1000° F.), e.g., 121° C. (250° F.) to 427° C. (800° F.), such as 149° C. (300° F.) to 371° C. (700° F.).

D. Example

FIG. 1 illustrates a conventional steam cracking process schematic 100 where a side product stream is recycled for use as a quench oil. The steam cracking process 100 includes a conventional pyrolysis furnace 102 having (not shown) convection and radiant sections. A hydrocarbon feedstock (first mixture) 101 typically enters the convection section of the furnace where the first mixture's hydrocarbon component is heated and vaporized by indirect contact with hot flue gas from the radiant section and by direct contact with the first mixture's steam component. The steam-vaporized first mixture is then introduced into the radiant section where the first mixture is bulk cracked. A pyrolysis effluent 105 (second mixture) is conducted away from the pyrolysis furnace 102, the second mixture 105 comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, side product, water, unreacted hydrocarbon components of the first mixture, etc. The separation stage can comprise, e.g., a primary fractionator. Generally, a cooling stage, typically either a direct quench or indirect heat exchange is located between the pyrolysis furnace and the separation stage.

Cooling the second mixture 105 downstream of the pyrolysis furnace 102 is performed by a system 110 comprising one or more transfer line heat exchangers ("TLE"). For example, the transfer line heat exchangers can cool the second mixture to about 650° C., in order to efficiently generate super-high pressure steam 108 which can be utilized by the process or conducted away. When a TLE is used, the second mixture is a cooled second mixture 105'. Note that in some embodiments, system 110 is not used. The second mixture 105 (or cooled second mixture 105') can be subjected to direct quench to form a third mixture 119 (e.g., a quenched mixture) at a quench point 120 typically between the furnace outlet 103 of the pyrolysis furnace 102 and the separation stage (discussed below). The quench can be accomplished by contacting the second mixture with the side product, in lieu of, or in addition to the treatment with transfer line exchangers. Where employed in conjunction with at least one transfer line exchanger, the side product 175 is introduced at a point downstream of the transfer line exchanger(s). In this embodiment, the side product 175 comprises a side product cut (e.g., a conventional quench oil side stream) taken at about 180° C. through outlet 170 from the primary fractionator 125 and pump 172.

A separation stage can be utilized downstream of the pyrolysis furnace 102 and downstream of the cooling system 110 (e.g., transfer line exchanger) and/or quench point 120 for separating from the third mixture 119 (e.g., the quenched mixture) one or more of light olefin, side product, SCN, SCGO, SCT, or water. Various separation apparatus may be utilized such as a primary fractionator 125. Optional separation equipment can be utilized in the separation stage, e.g., one or more flash drums, fractionators, water-quench towers, indirect condensers, etc., such as those described in U.S. Pat. No. 8,083,931. In the separation stage, a fourth mixture 130 (e.g., a tar stream) can be separated from the other components in the fractionator, with the fourth mixture 130 comprising ≥10.0 wt. % of the third mixture's TH based on the weight of the third mixture's TH. When the pyrolysis process is steam cracking, the fourth mixture 130 (the primary fractionator bottoms) generally comprises SCT, which is obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof.

The primary fractionator 125 also contains outlets for other components flowing through the primary fractionator. For example, hydrocarbons in the SCN boiling range are conducted away from the primary fractionator 125 via SCN outlet 140 and pump 142 through SCN line 145; hydrocarbons in the SCGO boiling range are conducted away from the primary fractionator 125 via SCGO outlet 150 and pump 152 through SCGO line 155; water can be removed from the primary fractionator 125 via water outlet 160 and pump 162 through water line 165; and side product can be removed from the primary fractionator 125 via side product outlet 170 and pump 172 through side product line 175. Side product line 175 generally has a normal boiling point range of about 93° C. (200° F.) to 538° C. (1000° F.), e.g., 121° C. (250° F.) to 427° C. (800° F.), such as 149° C. (300° F.) to 371° C. (700° F.). For example, the side product can have a normal boiling point of about 180° C. In aspects where SCT is separated and conducted away upstream of the primary fractionator (not shown), the primary fractionator bottoms 135 typically has a normal boiling point range of about 93° C. (200° F.) to 538° C. (1000° F.), e.g., 121° C. (250° F.) to 427° C. (800° F.), such as 149° C. (300° F.) to 371° C. (700° F.).

The conventional steam cracking process as outlined above suffers from fouling due to the significant amount of free radicals and vinyl aromatic species flowing into the primary fractionator. While not wishing to be bound by any theory or model, it is believed that this problem is exacerbated by the presence of free radicals and vinyl aromatics in conventional quench streams, e.g., when side product line 175 is used as the quench stream.

Contrary to expectations, various solvent streams produced during hydrotreatment processes (e.g., a SATC process) have been found to be good hydrogen donor solvents. These solvent streams contain hydrogen donor molecules such as dihydroanthracene and tetralin that can capture free radicals flowing from the pyrolysis furnace and/or the cooling system (e.g., the TLE) and form stable products before reaching the primary fractionator. Because the SATC process generates excess solvent (e.g., hydroprocessed tar, TLP, and/or mid-cut), the solvent can be used to replace the side product as a quench oil. Doing so significantly reduces (and/or eliminates) fouling in the various components (e.g., the primary fractionator) of steam cracking processes.

Figure 2:
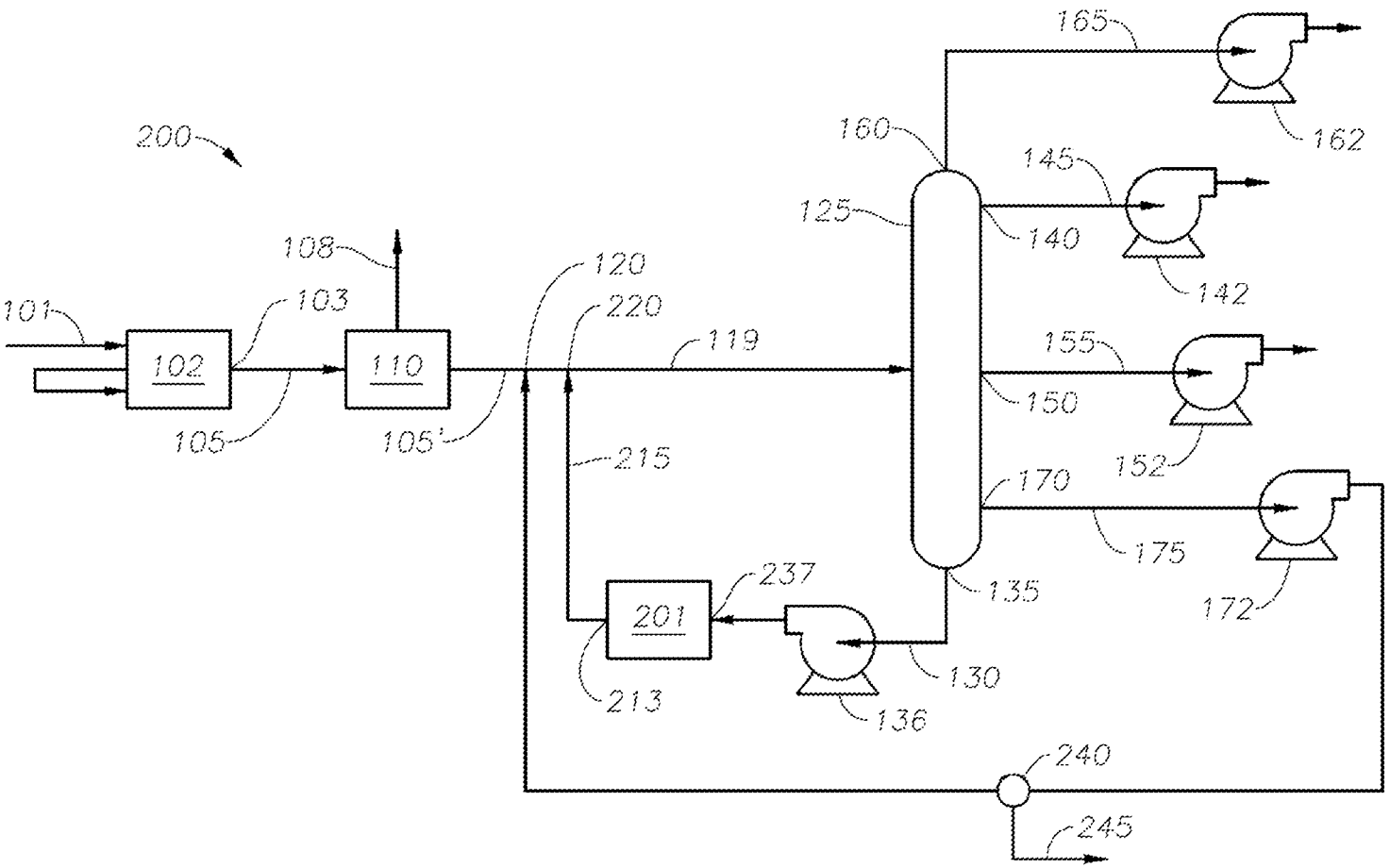
FIG. 2 schematically illustrates a steam cracking process, according to certain embodiments.

FIG. 2 illustrates a non-limiting embodiment of a steam cracking process schematic 200 where a mid-cut stream is recycled for use as a quench oil composition and/or is combined with one or more effluent streams, e.g., effluent streams flowing from a primary fractionator. Suitable quench oils are not limited to those comprising mid-cut, and a variety of other quench oils are within the scope of the invention. For example, suitable quench oils include those comprising at least a portion of the total solvent output produced during the hydrotreatment process, e.g. during the SATC process, or the total solvent output minus the $H_2S$ produced during the SATC process, or the hydroprocessed tar produced during the SATC process, or the TLP produced during the SATC process, or the mid-cut produced during the SATC process, or combinations thereof.

A steam cracking process 200 includes a conventional pyrolysis furnace 102 which has two main sections: a convection section and a radiant section. A hydrocarbon feedstock (first mixture) 101 typically enters the convection section of the furnace where the first mixture's hydrocarbon component is heated and vaporized by indirect contact with hot flue gas from the radiant section and by direct contact with the first mixture's steam component. The steam-vaporized first mixture is then introduced into the radiant section where the first mixture is bulk cracked. A pyrolysis effluent 105 (second mixture) is conducted away from the pyrolysis furnace 102, the second mixture 105 comprising products resulting from the pyrolysis of the first mixture and any unreacted components of the first mixture. At least one separation stage is generally located downstream of the pyrolysis furnace, the separation stage being utilized for separating from the second mixture one or more of light olefin, SCN, SCGO, SCT, water, unreacted hydrocarbon components of the first mixture, etc. The separation stage can comprise, e.g., a primary fractionator. Generally, a cooling stage, typically either a direct quench or indirect heat exchange is located between the pyrolysis furnace and the separation stage.

Cooling the second mixture 105 downstream of the pyrolysis furnace 102 is performed by a system 110 comprising one or more transfer line heat exchangers ("TLE"). For example, the transfer line heat exchangers can cool the second mixture to about 650° C., in order to efficiently generate super-high pressure steam 108 which can be utilized by the process or conducted away. When a TLE is used, the second mixture is a cooled second mixture 105'. Note that in some embodiments, system 110 is not used. The second mixture 105 (or cooled second mixture 105') can be subjected to direct quench to form a third mixture 119 (e.g., a quenched mixture) at a quench point 220 typically between the furnace outlet 103 of the pyrolysis furnace 102 and the separation stage (discussed below). The quench can be accomplished by contacting the second mixture with a quench oil composition, in lieu of, or in addition to the treatment with transfer line exchangers. Where employed in conjunction with at least one transfer line exchanger, the quench oil 215 is introduced at a point downstream of the transfer line exchanger(s). In this embodiment, the quench oil composition 215 comprises the mid-cut flowing through outlet 213 from the hydrotreatment process 200 (e.g., SATC process). In other embodiments, the quench oil composition comprises one or more of a solvent stream produced during a hydrotreatment process (e.g., a hydroprocessed tar and/or a TLP). As stated above, the hydroprocessed tar and TLP are produced during the SATC process 200. The quench oil composition optionally includes other liquid quench oils, such as those obtained by a downstream quench oil knock-out drum, pyrolysis fuel oil and water, which can be obtained from conventional sources, e.g., condensed dilution steam.

In certain embodiments, the side product flowing through side product line 175 can be added to the effluent flowing from the pyrolysis furnace and or TLE at mixing point 120. The side product of product line 175 generally has a normal boiling point range of about 93° C. (200° F.) to 538° C. (1000° F.), e.g., 121° C. (250° F.) to 427° C. (800° F.), such as 149° C. (300° F.) to 371° C. (700° F.). In aspects where SCT is separated upstream of the primary fractionator (not shown) and conducted away for SCT processing in an SATC process, the primary fractionator bottoms 135 typically has a normal boiling point range of about 93° C. (200° F.) to 538° C. (1000° F.), e.g., 121° C. (250° F.) to 427° C. (800° F.), such as 149° C. (300° F.) to 371° C. (700° F.). Those skilled in the art will appreciate that side product line 175 of FIG. 2 is not a conventional quench oil cut, and as such it differs from side product line 175 of FIG. 1. The side product cut of 175 of FIG. 2 comprises (i) at least a portion of the recycled side product cut introduced into the cooled pyrolysis effluent at location 120, and (i) that portion of the quench oil composition that is (a) introduced into the partially-quenched pyrolysis effluent at location 220 and (b) is in an appropriate boiling point range for removal from the primary fractionator 125 at location 170. The adding of the side product flowing through side product line 175 to the effluent flowing from the pyrolysis furnace and or TLE at mixing point 120 can be performed when process begins, that is, during the time the hydrotreatment process (e.g., the SATC process) is generating the desired quench oil composition. In some embodiments, the steam cracking process includes a control valve 240 that can be actuated to direct the side product stream to line 245, such that side product stream is no longer flowing to mixing point 120.

A separation stage can be utilized downstream of the pyrolysis furnace 102 and downstream of the cooling system 110 (e.g., transfer line exchanger) and/or quench point 120 for separating from the third mixture 119 (e.g., the quenched mixture) one or more of light olefin, side product, SCN, SCGO, SCT, or water. Various separation apparatus may be utilized such as a primary fractionator 125. Optional separation equipment can be utilized in the separation stage, e.g., one or more flash drums, fractionators, water-quench towers, indirect condensers, etc., such as those described in U.S. Pat. No. 8,083,931. In the separation stage, a fourth mixture 130 (e.g., a tar stream) can be separated from the other components in the fractionator, with the fourth mixture 130 comprising ≥10.0 wt. % of the third mixture's TH based on the weight of the third mixture's TH. When the pyrolysis process is steam cracking, the fourth mixture 130 (the primary fractionator bottoms) generally comprises SCT, which is obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. The fourth mixture 130 flows from the primary fractionator 125 through outlet 135 via pump 136 to the SATC process inlet 137 to undergo a SATC process.

The primary fractionator 125 also contains outlets for other components flowing through the primary fractionator. For example, hydrocarbons in the SCN boiling range are conducted away from the primary fractionator 125 via SCN outlet 140 and pump 142 through SCN line 145; hydrocarbons in the SCGO boiling range are conducted away from the primary fractionator 125 via SCGO outlet 150 and pump 152 through SCGO line 155; water can be removed from the primary fractionator 125 via water outlet 160 and pump 162 through water line 165; and side product can be removed from the primary fractionator 125 via side product outlet 170 and pump 172 through side product line 175.

Advantageously, the mid-cut produced by the SATC process can be used as a quench oil composition at various points along the pyrolysis process (before SATC) to reduce and/or eliminate reactor fouling. Without being bound by theory, it is believed that the reduction in (or elimination of) reactor fouling is due to the hydrogen donating ability of the mid-cut composition. This mid-cut composition transfers hydrogen radicals to reactive radicals in various effluent streams, thereby mitigating olefin polymerization and minimizing or eliminating primary fractionator fouling. Additionally, the mid-cut produced by the SATC process can be used to mix with various effluent streams in the steam cracking process.

Furthermore, TLP and hydroprocessed tar can be used as a quench oil composition at various points along the pyrolysis process (before SATC) to reduce or eliminate reactor fouling. It is believed that the TLP and the hydroprocessed tar act similarly to the mid-cut when the mid-cut is used as a quench oil. Additionally, the TLP and the hydroprocessed tar can be used to mix with various effluent streams in the steam cracking process.

Advantageously, the various streams are used to mitigate fouling in downstream processing equipment in a stream cracker, such as the primary fractionator. Moreover, the yield of the product is better. Uncontrolled reactions involving reactive radicals, in conventional processes, lead to polymerization and/or coking, which lead to heavier products such as tar, coke, and fuel gas.

II. Chemical Composition of Mid-Cut Produced from the SATC Process

The mid-cut produced from SATC processes contains a chemical composition which is different from virgin crude oil and any other typical refinery stream in the same boiling point temperature range. This unusual chemical composition is a result of various degrees of hydrocracking and hydrotreating of steam cracked tar. Depending on the severity of cracking and hydrotreating, many different types of partially or fully saturated aromatic ring molecules are formed which do not exist in traditional virgin crude oil and/or other heavy oil fraction upgrade. The specific set of molecules produced has special physical and chemical properties. For example, the mid-cut has a lower density than most other similar aromatic solvents in the same molecular weight range. Additionally, for example, the mid-cut has much better solubility and/or compatibility with aliphatic molecules than most other similar aromatic solvents due to the high saturated ring content of the mid-cut.

The hydrocracking process in the SATC process converts large multi-core molecules to medium and/or small single core compounds. Such compounds include compounds in the compound classes of pyrenes (I), phenanthrenes (II), acenaphthalenes (III), naphthalenes (IV), dibenzothiophenes (VI), benzothiophenes (V), benzenes (V-1), and paraffins (VIII) as shown in Table 1. These molecules can have one or more alkyl substituents attached to the ring systems.

The other major conversion process in the SATC process is hydrotreating. Hydrotreating partially and/or fully saturates aromatic rings depending on the severity of the hydrotreating, as shown in Table 1. The identification and quantity of the compound classes in the SATC mid-cut is determined by GC×GC-FIMS and GC×GC-FID chromatography (Table 1).

TABLE 1

Weight Percent for Compound Classes in the SATC Mid-Cut

| Formula | Name | Structure | Wt. % |
|---|---|---|---|
| I | pyrenes | 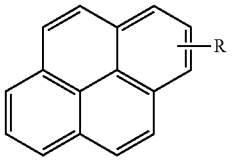 | 1.03 |

TABLE 1-continued

Weight Percent for Compound Classes in the SATC Mid-Cut

| Formula | Name | Structure | Wt. % |
|---|---|---|---|
| I-1 | dihydro-pyrenes | 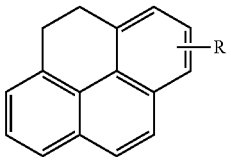 | 0.89 |
| I-2 | tetrahydro-pyrenes | 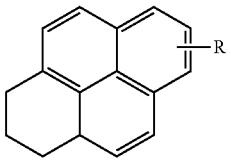 | 0.27 |
| I-3 | tetrahydro-pyrenes | 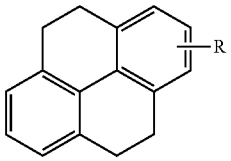 | 0.26 |
| I-4 | 1,2,3,6,7,8-hexahydropyrenes | 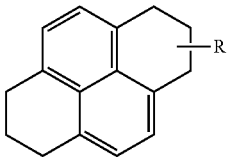 | 1.84 |
| I-5 | hexahydro-pyrenes | 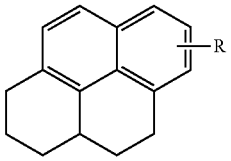 | 0.90 |
| I-6 | decahydro-pyrenes | 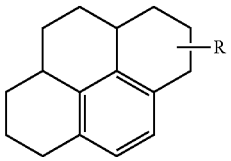 | 1.98 |
| I-7 | decahydro-pyrenes | 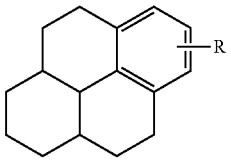 | 1.73 |
| I-8 | hexadecahydro-pyrenes | 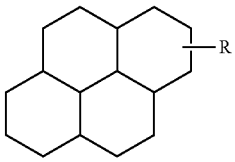 | 0.89 |
| II | phenanthrenes | 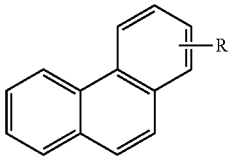 | 2.03 |

TABLE 1-continued

Weight Percent for Compound Classes in the SATC Mid-Cut

| Formula | Name | Structure | Wt. % |
|---|---|---|---|
| II-1 | dihydro-phenanthrenes | 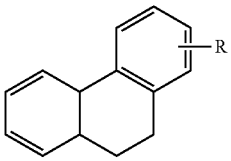 | 2.53 |
| II-2 | tetrahydro-phenanthrenes | 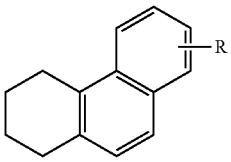 | 5.3% |
| II-3 | octahydro-phenanthrenes | 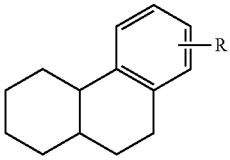 | 8.23 |
| II-4 | octahydro-phenanthrenes | 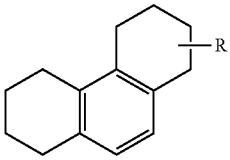 | 7.22% |
| II-5 | tetradecahydro-phenanthrenes | 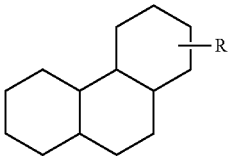 | 3.14 |
| III | acenaphthalenes | 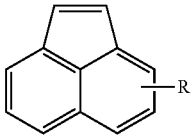 | 2.68 |
| III-1 | acenaphthenes | 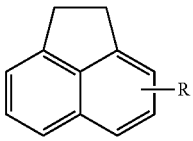 | 4.06 |
| III-2 | tetrahydro-acenaphthalenes | 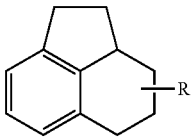 | 2.50 |
| III-3 | decahydro-acenaphthalenes | 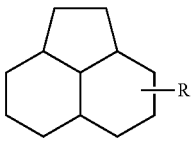 | 2.31 |

TABLE 1-continued

Weight Percent for Compound Classes in the SATC Mid-Cut

| Formula | Name | Structure | Wt. % |
|---|---|---|---|
| IV | naphthalenes | 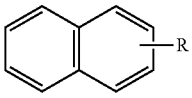 | 3.89 |
| IV-1 | tetrahydro-naphthalenes | 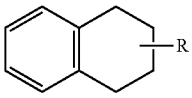 | 22.51 |
| IV-2 | decahydro-naphthalenes | 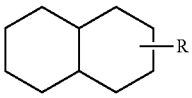 | 5.73 |
| VI | dibenzothiophenes | 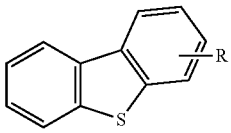 | 0.30 |
| V | benzothiophenes | 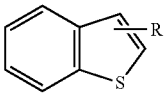 | 0.11 |
| VI-1 | biphenyls | 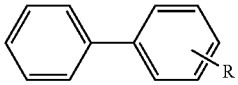 | 6.22 |
| V-1 | benzenes | 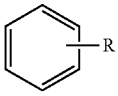 | 3.69 |
| VII | Monocylic saturated hydrocarbons | 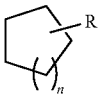 n = 0 to 15 | 1.70 |
| VIII | paraffins | $CH_3—(CH_2)_n—CH_3$ n = 0 to 40 | 0.30 |

In Table 1, R is one or more R groups, wherein each R group is a $C_1$ to $C_{10}$ alkyl radical. The weight percent of each compound class is based on the total weight percent of the mid-cut (i.e., the total weight percent of the quench oil composition).

As described above, the mid-cut (i.e., mid-cut solvent or mid-cut recycled products) can be recycled back into a steam cracking process to be used as a quench oil composition and/or used to mix with one or more effluent streams of the steam cracking process. The reactive radicals in the effluent streams are captured by species within the mid-cut that donate hydrogen to the reactive radicals. As a result, the amount of free radical initiators is significantly reduced (or eliminated), thereby mitigating olefin polymerization and minimizing or eliminating primary fractionator fouling.

The chemical composition of the mid-cut produced from SATC processes is determined by GC×GC×MS. Identifying and quantifying the compound classes in the mid-cut includes combining the information obtained from one or more of: retention position matching with standard compounds; GC×GC-FID (GC×GC using flame ionization detection), GC×GC-EIMS (GC×GC used with electron ionization mass spectrometry); and GC×GC-FIMS (GC×GC used with field ionization mass spectrometry). The GC×GC-FID and GC×GC-FIMS data is mainly used for the separation of the compound classes in the mid-cut. The GC×GC-FID and GC×GC-FIMS data is mainly used for composition quantitation. The GC×GC-EIMS and GC×GC-FIMS data is mainly used for the molecular structure identification of the compound classes in the mid-cut. The GC×GC-FID and GC×GC×MS system used to separate, identify, and quantify the compound classes of the mid-cut produced from the SATC process are described below.

In certain embodiments, a mid-cut composition is characterized by a concentration of donatable hydrogen. The concentration of donatable hydrogen in the mid-cut is about 0.5 wt. % or more, such as about 1.0 wt. % or more, such as about 1.5 wt. % or more, such as about 2.0 wt. % or more, such as about 2.5 wt. % or more, based on the total weight percent of the mid-cut.

In certain embodiments, the mid-cut comprises one or more of the compound classes shown in Table 2.

TABLE 2

Compound Classes in the Mid-Cut (I-1)

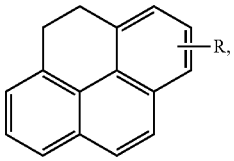

(I-2)

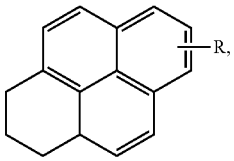

(I-3)

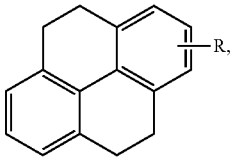

(I-4)

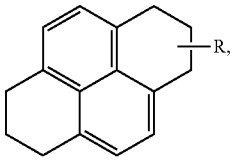

(I-5)

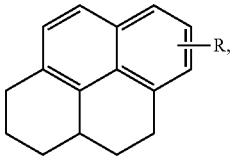

(I-6)

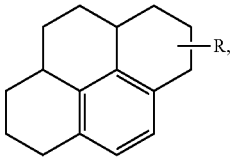

TABLE 2-continued

| Compound Classes in the Mid-Cut | |
|---|---|
| 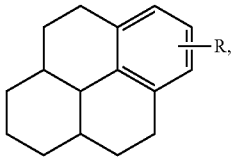 | (I-7) |
| 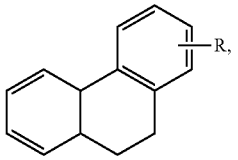 | (II-1) |
| 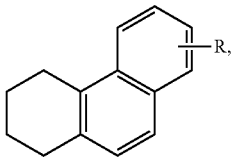 | (II-2) |
| 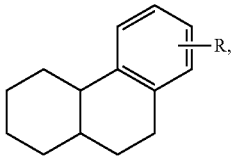 | (II-3) |
| 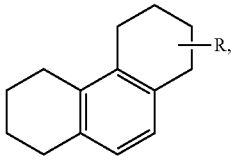 | (II-4) |
| 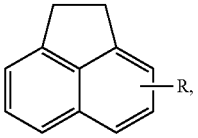 | (III-1) |
| 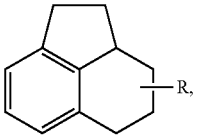 | (III-2) |
| and | |
| 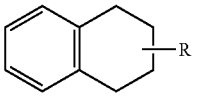 | (IV-1) |

wherein, R is one or more R groups, wherein each R group is a $C_1$ to $C_{10}$ alkyl radical.

In certain embodiments, the weight percent of each compound class in the SATC mid-cut has the weight percent shown in Table 3.

TABLE 3

| Weight Percent for Compound Classes in the SATC Mid-Cut | |
|---|---|
| Compound Class Formula | weight % |
| I-1 | 9.0% or less |
| I-2 | 3.0% or less |
| I-3 | 3.0% or less |
| I-4 | 19.0% or less |
| I-5 | 9.0% or less |
| I-6 | 20.0% or less |
| I-7 | 18.0% or less |
| II-1 | 25.0% or less |
| II-2 | 30.0% or less |
| II-3 | 30.0% or less |
| II-4 | 30.0% or less |
| III-1 | 30.0% or less |
| III-2 | 30.0% or less |
| IV-1 | 50.0% or less |

In certain embodiments, the weight percent of each compound class in the SATC mid-cut has the weight percent shown in Table 4.

TABLE 4

| Weight Percent for Compound Classes in the SATC Mid-Cut | |
|---|---|
| Compound Class Formula | weight % |
| I-1 | 4.5% or less |
| I-2 | 1.5% or less |
| I-3 | 1.5% or less |
| I-4 | 10.0% or less |
| I-5 | 4.5% or less |
| I-6 | 10.0% or less |
| I-7 | 9.0% or less |
| II-1 | 12.0% or less |
| II-2 | 15.0% or less |
| II-3 | 15.0% or less |
| II-4 | 15.0% or less |
| III-1 | 15.0% or less |
| III-2 | 15.0% or less |
| IV-1 | 25.0% or less |

End Uses

The process effluent compositions described herein (e.g., hydroprocessed tar, TLP, and mid-cut) are produced from hydrotreatment processes (e.g., from SATC processes). These process effluent compositions include specific chemical classes of molecules that, due to its unique set of physical and chemical properties, can be used to fulfill many unique applications that cannot be fulfilled from current hydrocarbon stream produced from virgin crude oil refinery or other heavy oil fraction upgrade. These process effluent compositions as produced from the SATC processes disclosed herein are useful in applications such as passenger car fuel, solvent, hydrocarbon solvent, lube base stocks, heat transfer oils, marine fuel oil, and heating oil.

In certain embodiments, a hydrocarbon mixture is provided. In certain embodiments, the hydrocarbon mixture comprises any of the process effluent compositions described herein, e.g., any of the SATC effluent compositions described herein. In these and other embodiments, the hydrocarbon mixture has a composition consistent with any one of Tables 1-4, and optionally has a normal boiling point range of from 93° C. (200° F.) to 538° C. (1000° F.), e.g., 121° C. (250° F.) to 427° C. (800° F.), such as 149° C. (300° F.) to 371° C. (700° F.). Normal boiling point distributions can be determined, e.g., by conventional methods such as the method of ASTM D7500. When the final boiling point is greater than that specified in the standard, the normal boiling point distribution can be determined by extrapolation.

In certain embodiments, a hydrocarbon mixture for use as a solvent for heavy hydrocarbon processing such as a SATC process is provided. In certain embodiments, the hydrocarbon mixture for use as a solvent for heavy hydrocarbon processing such as solvent assisted tar conversion comprises any of the process effluent compositions described herein. In these and other embodiments, the hydrocarbon mixture for use as a solvent for heavy hydrocarbon processing has a composition consistent with any one of Tables 1-4, and optionally has a normal boiling point range of from 93° C. (200° F.) to 538° C. (1000° F.), e.g., 121° C. (250° F.) to 427° C. (800° F.), such as 149° C. (300° F.) to 371° C. (700° F.).

In certain embodiments, a hydrocarbon mixture for use as a solvent for use in industrial applications is provided. In certain embodiments, the hydrocarbon mixture for use as a solvent for use in industrial applications comprises any of the process effluent compositions described herein. In these and other embodiments, the hydrocarbon mixture for use in industrial applications has a composition consistent with Tables 1-4, and optionally has a normal boiling point range of from 93° C. (200° F.) to 538° C. (1000° F.), e.g., 121° C. (250° F.) to 427° C. (800° F.), such as 149° C. (300° F.) to 371° C. (700° F.).

In certain embodiments, a hydrocarbon mixture for use as a heat transfer oil (such as a transform oil) is provided. In certain embodiments, the hydrocarbon mixture for use as a heat transfer oil comprises any of the process effluent compositions described herein. In these and other embodiments, the hydrocarbon mixture for use as a heat transfer oil has a composition consistent with Tables 1-4, and optionally has a normal boiling point range of from 93° C. (200° F.) to 538° C. (1000° F.), e.g., 121° C. (250° F.) to 427° C. (800° F.), such as 149° C. (300° F.) to 371° C. (700° F.).

III. Instrumentation and Experimental

Samples for GC×GC×FID and GC×GC×MS are taken from the steam cracked gas oil (a co-product of steam cracking recovered as a side draw off the primary fractionator). The samples contain compounds having normal boiling points in the range of about 150° C. to about 430° C. (such as in the range of about 300° F. to about 800° F.), the compounds typically being hydrocarbons having carbon numbers in the range of from approximately $C_8$ to $C_{28}$.

The GC×GC-FID and the GC×GC×MS system has an Agilent 7890 gas chromatograph (Agilent Technology, Wilmington, DE) configured with inlet, columns, and flame ionization detector ("FID"). A split/splitless inlet system with a sixteen-vial tray autosampler is used. The two-dimensional capillary column system utilizes a combination of weak-polar first column (BPX-5, 30 m, 0.25 mm i.d., 1.0 μm film) and a mid-polar second column (BPX-50, 3 m, 0.10 mm i.d., 0.10 μm film) (both from SGE Analytical Science, Austin, TX). A ZX1, looped jet thermal modulation assembly based on Zoex technology, (Zoex Corp., Houston, TX), which is a cold nitrogen gas cooled (liquid nitrogen heat exchanged) "trap-release" looped thermal modulator, is installed between these two columns.

The GC×GC output is split into two streams, one stream connected to a flame ionization detector ("FID"), the other stream connected to an ion source of a mass spectrometer ("MS") via a transfer line. The MS used is a JMS-T100GCV 4G (JEOL, Tokyo, Japan), time-of-flight mass spectrometer ("TOFMS") system (mass resolution (full-width half maximum) of 8000 and a mass accuracy specification of 5 ppm), equipped with either an electron ionization ("H") or field ionization ("FI") source. The switch between EI mode and FI mode can be achieved within 5 minutes without venting using a probe to change the ion source. The maximum sampling rate can be up to 50 Hz, which is sufficient to meet the required sampling rate for preserving GC×GC resolution.

A 0.2 μL sample is injected via a split/splitless (S/S) injector with 50:1 split at 300° C. in constant flow mode of 2.0 mL per minute helium. The oven is programmed from 45° C. to 315° at 3° C. per minute for a total run time of 90 min. The hot jet is kept at 120° C. above the oven temperature and then kept constant at 390° C. The MS transfer line and ion source are set at 350° C. and 150° C., respectively. The modulation period is 10 seconds. The sampling rate for the FID detector is 100 Hz, and for the mass spectrometer (both EI and FI mode) is 25 Hz. An Agilent Chemstation provides GC×GC control and data acquisition of FID. JEOL Mass Center software is used of MS data acquisition. The synchronization between GC×GC and MS is made using a communication cable from a GC remote control port to an MS external synchronization port.

The FID, EIMS, and FIMS data is processed for quantitative analysis using internally developed software. "PhotoShop" (Adobe System Inc., San Jose, CA) is used to generate the images.

All documents described herein are incorporated by reference herein, including any priority documents and/or testing procedures to the extent they are not inconsistent with this text. As is apparent from the foregoing general description and the specific embodiments, while forms of the embodiments have been illustrated and described, various modifications can be made without departing from the spirit and scope of the present disclosure. Accordingly, it is not intended that the present disclosure be limited thereby. Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "I" preceding the recitation of the composition, element, or elements and vice versa, e.g., the terms "comprising," "consisting essentially of," "consisting of" also include the product of the combinations of elements listed after the term.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

All priority documents are herein fully incorporated by reference for all jurisdictions in which such incorporation is permitted and to the extent such disclosure is consistent with the description of the present disclosure. Further, all documents and references cited herein, including testing procedures, publications, patents, journal articles, etc. are herein fully incorporated by reference for all jurisdictions in which such incorporation is permitted and to the extent such disclosure is consistent with the description of the present disclosure.

While the present disclosure has been described with respect to a number of embodiments and examples, those skilled in the art, having benefit of the present disclosure, will appreciate that other embodiments can be devised which do not depart from the scope and spirit of the present disclosure as described herein.

We claim:

1. A method for decreasing reactor fouling in a steam cracking process comprising:

steam cracking a hydrocarbon feed to obtain a quench oil composition comprising a concentration of donatable hydrogen of 0.5 wt. % or more based on a total weight percent of the quench oil composition;

adding the quench oil composition to a steam cracker effluent flowing from a pyrolysis furnace to form a mixture;

separating a steam cracker tar from the mixture;

hydroprocessing at least a portion of the separated steam cracker tar in a first hydroprocessing zone under catalytic hydroprocessing conditions to convert at least a portion of the separated steam cracker tar to a first hydroprocessed product;

separating from the first hydroprocessed product one or more of:

(i) an overhead stream comprising ≥about 1.0 wt. % of the first hydroprocessed product;

(ii) a mid-cut stream comprising ≥about 20 wt. % of the first hydroprocessed product; and (iii) a bottoms stream comprising ≥about 20 wt. % of the first hydroprocessed product; wherein the quench oil includes one or more of at least a portion of the overhead stream, at least a portion of the mid-cut stream, and at least a portion of the bottoms stream; and hydroprocessing at least a portion of the bottoms stream in a second hydroprocessing zone under second catalytic hydroprocessing conditions to convert at least a portion of the bottoms stream to a second hydroprocessed product, wherein the second hydroprocessed product has a sulfur content of 1.5 wt. % or less based on the total weight of the second hydroprocessed product.

2. The method of claim 1, wherein the quench oil includes at least a portion of the overhead stream, at least a portion of the mid-cut stream, or a mixture thereof.

3. The method of claim 1, further wherein the steam cracker effluent is cooled in at least one transfer line exchanger before the quench oil composition is added to the steam cracker effluent.

4. The method of claim 3, wherein the steam cracker tar is separated from the steam cracker effluent as a bottoms stream from a tar knock out drum and/or as a bottoms stream from a primary fractionator.

5. The method of claim 1, wherein the quench oil composition has a normal boiling point range of from 50° F. to 1400° F.

6. The method of claim 5, wherein the quench oil composition has a boiling point of from 300° F. to 700° F.

7. The method of claim 1, wherein the quench oil composition comprises a hydroprocessed tar.

8. The method of claim 1, wherein the quench oil composition comprises total liquid products from one or more of the first hydroprocessing zone and the second hydroprocessing zone.

9. The method of claim 1, further comprising heating the at least a portion of the separated steam cracker tar before hydroproces sing the at least a portion of the separated steam cracker tar in the first hydroproces sing zone.

10. The method of claim 1, wherein the concentration of donatable hydrogen is 1.5 wt. % or more based on the total weight percent of the quench oil composition.

11. The method of claim 1, wherein the quench oil composition comprises one or more compounds of one or more of the following classes of the formula:

(Class-A)

(I-1)

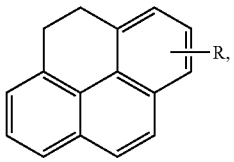

(I-2)

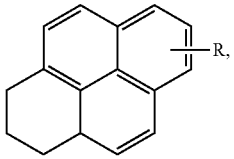

(I-3)

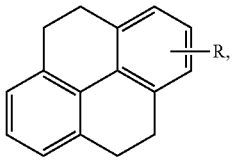

(I-4)

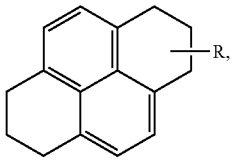

(I-5)

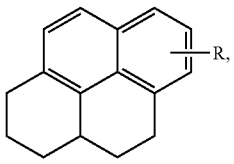

(I-6)

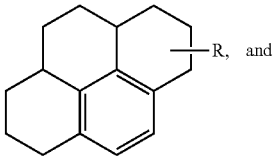

(I-7)

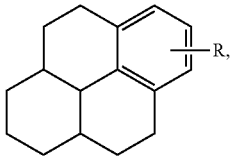

(Class-B)

-continued (II-1)

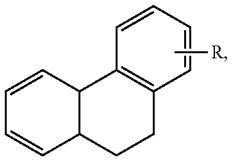

(II-2)

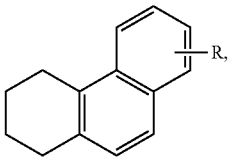

(II-3)

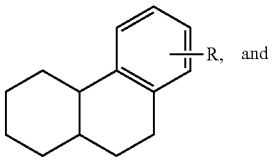

(II-4)

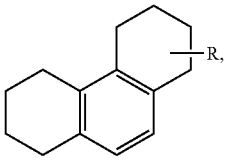

(Class-C)

(III-1)

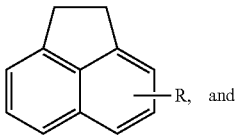

(III-2)

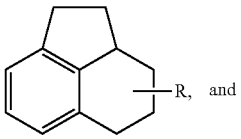

(Class-D)

(IV-1)

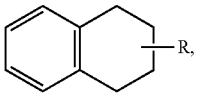

wherein:

R, the same or different, is one or more R groups, wherein each R group is a $C_1$ to $C_{10}$ alkyl radical.

12. The method of claim 11, wherein a weight percent of each compound class in the quench oil composition is:

| Compound Class Formula | weight % |
|---|---|
| I-1 | 9.0% or less |
| I-2 | 3.0% or less |
| I-3 | 3.0% or less |
| I-4 | 19.0% or less |
| I-5 | 9.0% or less |
| I-6 | 20.0% or less |
| I-7 | 18.0% or less |
| II-1 | 25.0% or less |
| II-2 | 30.0% or less |
| II-3 | 30.0% or less |
| II-4 | 30.0% or less |
| III-1 | 30.0% or less |
| III-2 | 30.0% or less |
| IV-1 | 50.0% or less |

based on a total weight percent of the quench oil composition.

13. The method of claim 11, wherein a weight percent of each compound class in the quench oil composition is:

| Compound Class Formula | weight % |
|---|---|
| I-1 | 4.5% or less |
| I-2 | 1.5% or less |
| I-3 | 1.5% or less |
| I-4 | 10.0% or less |
| I-5 | 4.5% or less |
| I-6 | 10.0% or less |
| I-7 | 9.0% or less |
| II-1 | 12.0% or less |
| II-2 | 15.0% or less |
| II-3 | 15.0% or less |
| II-4 | 15.0% or less |
| III-1 | 15.0% or less |
| III-2 | 15.0% or less |
| IV-1 | 25.0% or less |

based on the total weight percent of the quench oil composition.

14. A steam cracking process, comprising:

(a) steam cracking a hydrocarbon feed to produce a steam cracker effluent;

(b) adding a quench oil composition to the steam cracker effluent to produce a quenched mixture, wherein the quench oil composition comprises a concentration of donatable hydrogen of 0.5 wt. % or more based on a total weight percent of the quench oil composition;

(c) separating steam cracker tar from the quenched mixture;

(d) hydroproces sing at least a portion of the separated steam cracker tar in a first hydroprocessing zone under catalytic hydroprocessing conditions to produce a first hydroprocessor product comprising hydroprocessed steam cracker tar;

(e) separating at least a portion of the hydroprocessed steam cracker tar from the first hydroprocessor product; and (f) separating from the first hydroprocessor product (i) an overhead stream comprising ≥about 1.0 wt. % of the first hydroprocessed product;

(ii) a primarily liquid-phase mid-cut stream comprising ≥about 20 wt. % of the first hydroprocessed product; and (iii) a bottoms stream comprising ≥about 20 wt. % of the first hydroprocessed product;

(g) dividing the mid-cut stream into at least first and second portions;

(h) transferring the first portion to step (d), wherein the catalytic hydroprocessing conditions include combining at least a portion of the separated steam cracker tar with at least a portion of the transferred first portion; and transferring the second portion to step (b), wherein the quench oil composition comprises at least a portion of the transferred second portion.

15. The process of claim 14, wherein the quench oil composition in step (b) or a portion of the quench oil composition in step (b) that includes any portion of the first hydroprocessor product consists of the second portion transferred to step (b).

* * * * *